US006722179B1

(12) United States Patent
Ventura

(10) Patent No.: US 6,722,179 B1
(45) Date of Patent: Apr. 20, 2004

(54) DENT PULLER

(75) Inventor: George Ventura, Shawnee, KS (US)

(73) Assignee: Miracle Industries, Inc., Las Vegas, NV (US)

( * ) Notice: Subject to any disclaimer, the term of this patent is extended or adjusted under 35 U.S.C. 154(b) by 0 days.

(21) Appl. No.: 10/354,512

(22) Filed: Jan. 30, 2003

(51) Int. Cl.[7] ..... B21D 1/12
(52) U.S. Cl. ..... 72/454; 72/705; 81/124.2
(58) Field of Search ..... 72/454, 457, 705; 81/124.2

(56) References Cited

U.S. PATENT DOCUMENTS

| | | | | | |
|---|---|---|---|---|---|
| 2,949,144 | A | * | 8/1960 | Dredske et al. | 72/390.2 |
| 3,611,784 | A | * | 10/1971 | Prichard | 72/458 |
| 4,116,035 | A | * | 9/1978 | Malarsky | 72/389.6 |
| 4,357,845 | A | * | 11/1982 | Cornia | 81/125 |
| 4,503,701 | A | * | 3/1985 | Hardy | 72/372 |
| 4,653,167 | A | * | 3/1987 | Mullins | 29/402.18 |
| 5,951,818 | A | * | 9/1999 | Gaetano | 156/535 |

OTHER PUBLICATIONS

Web pages for Ding King Tool published on www.dingking.com website showing product believed to have been on sale more than one year prior to filing date of present application.

* cited by examiner

*Primary Examiner*—Lowell A. Larson
(74) *Attorney, Agent, or Firm*—Erickson & Kleypas, L.L.C.

(57) ABSTRACT

A dent puller includes a bridge having a pair of legs extending outwardly and downwardly therefrom at an angle of approximately forty-five degrees. Each leg has a lower end with a foot. Each foot has a resilient pad secured thereto. An aperture formed through the bridge receives a shaft. An engagement member connected to a lower end of the shaft includes a plate having at least one opening extending therethrough. A knob is connected to the shaft such that application of a rotational force to the knob acts to draw the engagement member toward the bridge. The dent puller may further include a tool adapter comprising a socket engageable with the knob and an arbor extending axially outward from the socket.

22 Claims, 2 Drawing Sheets

Fig. 1.
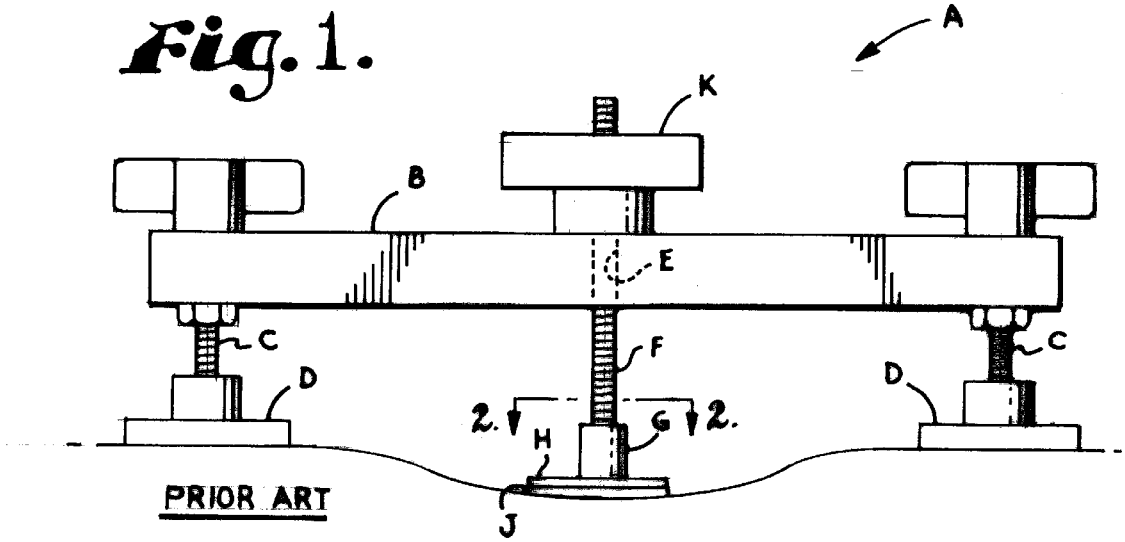
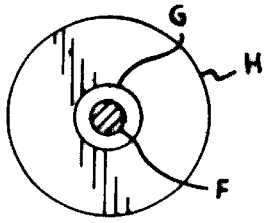
Fig. 2.
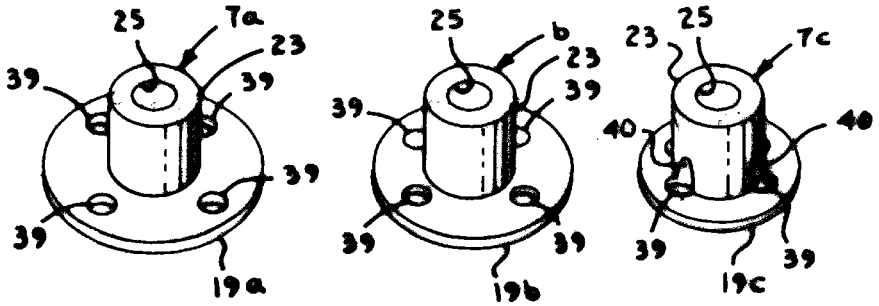
Fig. 6.

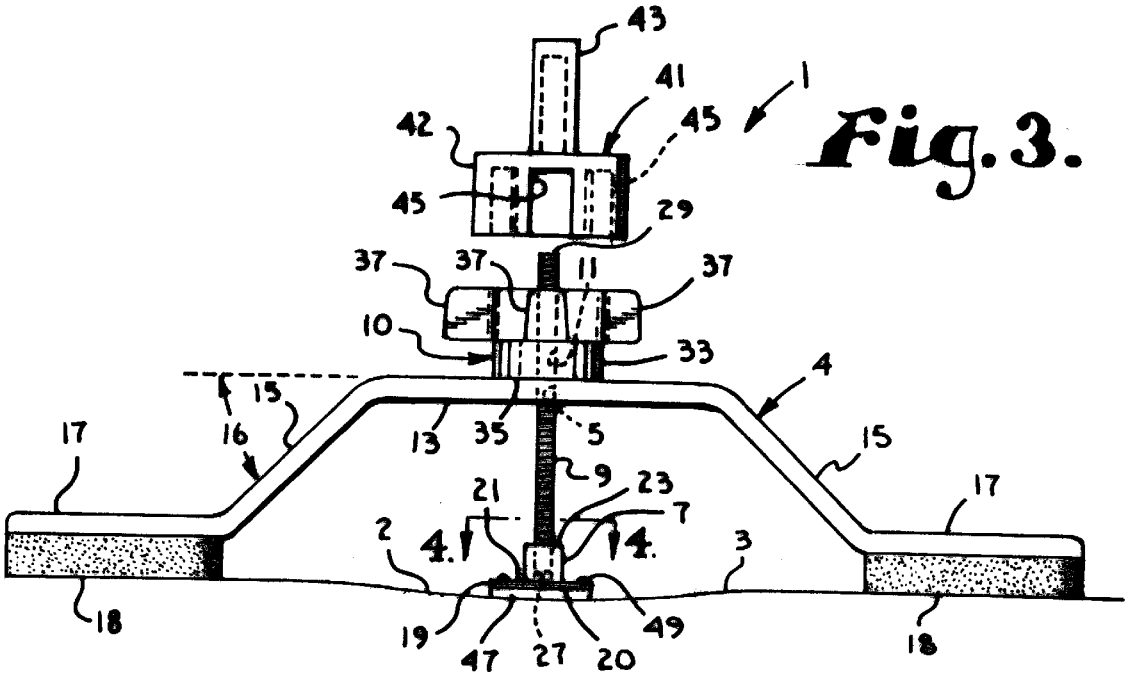
Fig. 3.
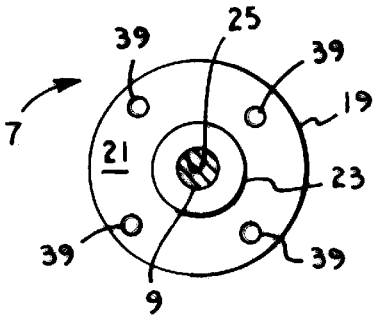
Fig. 4.
Fig. 5.
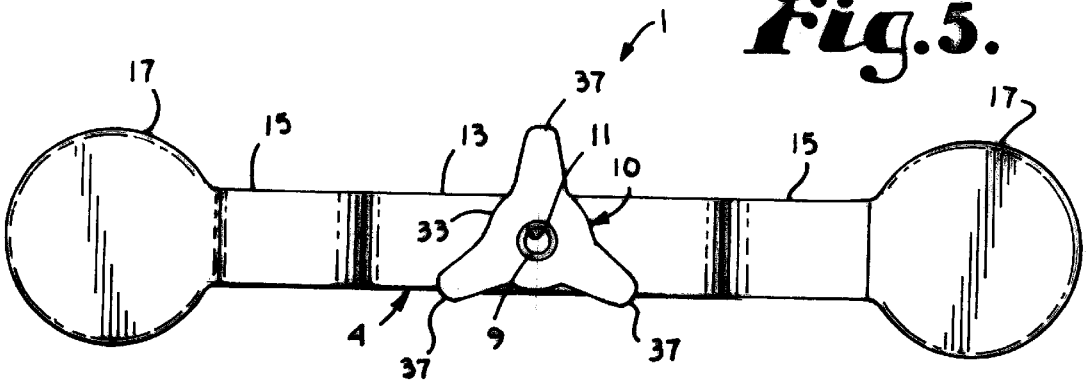

DENT PULLER

BACKGROUND OF THE INVENTION

1. Field of the Invention

This invention relates to dent pullers for automobile body repair, and more particularly to a dent puller of the type having a plate which is adhesively bonded to a depressed area in an automobile surface and a bridge structure toward which the plate is pulled to remove the dent.

2. Description of the Related Art

Various types of dent pullers have been used in automobile body repair for removing dents from body panels. Some of these devices require that holes be drilled in the body panel in order to attach the dent puller to the damaged area of the panel. These holes must later be filled and the panel repainted. Other devices are designed to remove small dents without causing further damage to the body panel. Use of these latter devices generally does not require repainting of the panel, and is thus referred to as "paintless" dent repair.

One common type of prior art dent puller for paintless dent repair is shown in FIGS. 1 and 2. The puller A comprises a straight bridge B having a leg C attached near each end. Each leg C terminates with a foot D. The legs C are generally perpendicular to the bridge B. Midway along the length of the bridge B is an aperture E through which a threaded shaft F is received. A lower end of the shaft F is connected to an engagement member G having a flat plastic plate H, which is, in turn, adhered to the body panel near the center of the dent using a specialized hot melt adhesive J. A knob or wing nut K is threadably received on the upper end of the shaft F.

By tightening down on the knob or wing nut K, an operator can cause the engagement member G to be pulled toward the bridge B. As the engagement member G moves, the adhesive bond between the plate H and the body panel causes the dented portion of the panel to be pulled toward its correct alignment. When the force exerted by the knob K acting against the bridge B becomes greater than the strength of the adhesive J, the plate H will pull away from the body panel. The process is repeated until the dent is removed.

At least two problems are common with the prior art device. First, as the dent is removed, the device A tends to cause new dents in the body panel at the points where the feet D contact the panel. Second, when the plate H pulls away from the body panel, the adhesive J tends to remain adhered to the body panel. The adhesive J must then be removed from the panel using a solvent, creating extra work for the operator and providing an additional opportunity to damage the painted surface of the panel.

What is needed is a dent puller for paintless body repair which will not cause new dents in the panel and which will not leave adhesive adhered to the panel when the plate pulls away from the panel.

SUMMARY OF THE INVENTION

The dent puller of the present invention includes a bridge having a center section and a pair of legs extending outwardly and downwardly from the ends of the center section at an angle of approximately forty-five degrees. Each leg has a lower end with a foot extending outwardly therefrom such that the feet are generally parallel to the center section. Each foot has a resilient pad secured thereto.

An aperture formed through the center section of the bridge receives a threaded shaft having upper and lower ends. An engagement member connected to the lower end of the shaft includes a plate having an upper face, a lower face and at least one opening extending through the plate from the lower face to the upper face. A knob is threadably received on the upper end of the shaft such that application of a rotational force to the knob acts to draw the engagement member toward the bridge. The knob may include a hub and a plurality of lugs which extend radially outward therefrom.

The dent puller may further include a power tool adapter comprising a socket engageable with the knob and an arbor extending axially outward from the socket. The socket may include a plurality of radial notches which are sized and spaced to engage the lugs on the knob. At least a portion of the arbor is preferably hollow to provide clearance for the upper end of the shaft, which may extend outwardly past the upper margin of the knob.

It is believed that the angle of declination of the legs, acting in combination with the resilient pads on the feet, distributes the force exerted by the knob in such a way as to lessen the tendency of the puller to cause new dents in the body panel adjacent to the feet. Furthermore, it is believed that the openings in the plate act to increase the bond between the adhesive and the plate such that the adhesive will remain on the plate when the plate pulls away from the panel.

BRIEF DESCRIPTION OF THE DRAWINGS

FIG. 1 is a side view of a prior art dent puller.

FIG. 2 is a cross-sectional view showing the plate of the prior art dent puller taken generally along line 2—2 in FIG. 1.

FIG. 3 is a side elevational view of a dent puller embodying the present invention.

FIG. 4 is a cross-sectional view showing the plate of the dent puller of the present invention taken generally along line 4—4 in FIG. 3.

FIG. 5 is a top plan view of the dent puller of FIG. 3.

FIG. 6 is a perspective view of a set of engagement members for use with the dent puller of FIG. 3.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the FIGS. 3–6, the reference number 1 generally designates a dent puller embodying the present invention. The dent puller 1 is designed for use in removing a dent 2 from an automobile body panel 3. The dent puller 1 generally comprises a bridge 4 having an aperture 5 formed therethrough, an engagement member 7 having a threaded shaft 9 extending outwardly therefrom so as to be receivable through the aperture 5, and a knob or nut 10 having an internally threaded bore 11 which threadably receives the shaft 9.

The bridge 4 may be formed of any of a variety of suitably strong materials, including aluminum or glass filled polycarbonate, and includes a generally straight center section 13 and a pair of legs 15. The aperture 5 is located approximately midway along the length of the center section 13. Each of the legs 15 angles outwardly and downwardly from a respective end of the center section 13 at an angle of declination 16 which is preferably approximately equal to forty five degrees. Each leg 15 includes a foot 17 which is positioned at the lower end of the respective leg 15 and extends outwardly therefrom. The feet 17 lie in a plane which is generally parallel to the center section 13 and are shown as being circular in shape, however it is to be understood that other shapes will work as well. Each foot 15 has a resilient pad 18, such as a foam pad, adhered thereto for cushioning contact between the respective foot 17 and the body panel 3.

The engagement member 7 includes a plate 19 which is shown as being circular in shape, but may be of other shapes including oval and polygonal. The plate 19 includes an outer, bottom, or abutment surface 20 and an inner or upper surface 21. The engagement member 7 further includes a mounting boss 23 which extends outwardly from the inner surface 21 of the plate 19 and includes a threaded bore 25 for receiving a first end 27 of the shaft 9. A second end 29 of the shaft 9 extends through the aperture 5 in the bridge 4 and is received by the threaded bore 11 in the knob 10.

The knob 10 includes a hub 33. The threaded bore 11 is axially located and extends through the hub 33 of the knob 10. A thrust surface 35 is formed on the distal end of the hub 33 for bearing against the bridge 4. The knob 10 is shown as having three radially outward extending lugs 37, however it is to be understood that knobs 10 of other shapes may be used as well. For example, the knob 10 may comprise a nut, such as a hex or wing nut (not shown) or a crank handle (not shown).

As best seen in FIG. 4, the plate 19 further includes one or more openings 39 which pass therethrough from the outer surface 20 to the inner surface 21. Four circular openings 39 are shown, however it is to be understood that neither the number nor the shape of the openings 39 is critical to the present invention. More or less than four openings 39 can be used, and the shape of the openings 39 can be varied to include, for example, oblong, oval, or crescent shaped openings, as well as square, rectangular or otherwise polygonal openings.

Referring to FIG. 6, the dent puller 1 may be supplied with a plurality of engagement members 7 having respective plates 19 of different diameters to work with dents 2 of varying sizes; for example an engagement member 7*a* with a 1.25 inch diameter plate 19*a*, an engagement member 7*b* with a 1 inch diameter plate 19*b*, and an engagement member 7*c* with a 0.75 inch diameter plate 19*c*. Each of the engagement members 7 has at least one opening 39 formed through the respective plate 19. In the case of smaller diameter plates 19, such as plate 19*c*, the openings 39 may intersect the respective mounting boss 23 and form a breakout 40 therein.

Referring again to FIG. 3, the dent puller 1 may further include an adapter 41 having a socket 42 designed to engage the knob 10 and an arbor 43 designed to be engaged by a chuck of a power tool, such as an electric drill (not shown). The socket 42 is shown as being generally cylindrical and having three radially formed slots 45 sized and positioned to receive the three radially extending lugs 37 of the knob 10. The arbor 43 extends outwardly from the socket 41 along an axial centerline thereof. The arbor 43 is preferably hollow such that the second end 29 of the shaft 9 may be received therein as the knob 10 is advanced onto the shaft 9. The arbor 43 is shown as being hexagonally shaped so as to be easily and effectively gripped by the power tool. It is also foreseen that the arbor 43 could be shaped to be engaged by a non-power tool, such as a breaker bar or the like, which could be used to facilitate drawing the plate 19 toward the bridge 4

In use, one of the engagement members 7 is adhered to the body panel 3 in the center of the dent 2 using an adhesive 47. The preferred adhesive 47 is a hot melt glue stick type adhesive which can be applied using a glue gun which heats a portion of the glue stick above its melting point and includes a mechanism for forcing the melted adhesive through a nozzle on the glue gun. Preferred glue sticks include hot melt glue sticks sold by Gaden Corporation as Product #106 and #151 and which identifies the ingredients as an EVA-copolymer, synthetic resin and wax and a stabilizer. EVA-copolymer is believed to refer to an ethylene vinyl acetate copolymer which is believed to be a thermoplastic polymer. It is to be understood that glue sticks formed from other thermoplastic materials, including urethanes or polyolefins might also be suitable for use as the adhesive. In addition, it is foreseen that adhesives other than a hot melt type adhesive might be suitable for use with the dent puller 1 of the present invention.

The adhesive 47 is preferably applied to the abutment surface 20 of the plate 19 before the engagement member 7 is secured to the bridge 4. The user grasps the shaft 9 (which is already attached to the engagement member 7) and holds it such that the abutment surface 20 of the plate 19 faces upwardly. Adhesive is applied to the abutment surface 20 so as to cover the surface and fill the openings 39 therein. The plate 19 is then placed over the dent 2 and pressed lightly into place, forcing the excess adhesive 47 through the holes 39 to form a head 49 adjacent the inner surface 21, the heads 49 being wider than the holes 39. The adhesive 47 is allowed to dry or cure.

The bridge 4 is placed over the shaft 9 with the pads 18 of feet 17 resting on the panel 3. The knob 10 is then threaded onto the shaft 9 and tightened against the bridge 4 (either by hand or using a power tool via the adapter 41). As the knob 10 is tightened, the engagement member 7 is drawn toward the bridge 4, and thereby pulls the dent 2 out of the body panel 3. It is believed that the angle of declination 16 of the legs 15, acting in combination with the pads 18, distributes the force exerted by the knob 10 in such a way as to lessen the tendency of the puller 1 to cause new dents in the body panel 3 adjacent to the feet 17.

When the force exerted by the knob 10 acting against the bridge 4 becomes greater than the strength of the adhesive 47, the plate 19 will pull away from the body panel 3. The openings 39 in the plate 19 act to make it more likely that, when the plate 7 pulls away from the body panel 3, the adhesive 47 will remain adhered to the plate 19 instead of remaining on the body panel 3. It is believed that the openings 39 act to increase the bond between the adhesive 47 and the plate 19 in two ways: first, the openings 39 increase the surface area of the plate 19 to which the adhesive 47 is exposed, thereby increasing the adhesion, and second, the adhesive 47 flows through the openings 39 to form the head 49 which bears against the inner surface 21 of the plate 19 and thereby inhibits the adhesive 47 from coming off the plate 19.

Any adhesive which remains on the panel 3 can be removed using a solvent. The preferred solvent for the preferred adhesive comprises isopropyl alcohol.

It is to be understood that while certain forms of the present invention have been illustrated and described herein, it is not to be limited to the specific forms or arrangement of parts described and shown. For example, while the preferred embodiment described above has a knob 10 which threadably engages the shaft 9 and bears against the bridge 4 to draw the engagement member 7 toward the bridge 4, it is foreseen that the knob 10 could be fixedly attached to the shaft 9 and that the shaft 9 could, instead, threadably engage the bridge 4, by means such as female threads formed in the aperture 5. This alternative construction would operate in substantially the same way as described above; i.e. turning the knob 10 would cause the engagement member 7 to be drawn toward the bridge 4.

What is claimed and desired to be secured by Letters Patent is as follows:

1. A dent puller for removing a dent from a panel, comprising:

a) a bridge having:
   i) a center section with opposed first and second ends, said center section having an aperture extending therethrough between said first and second ends;
   ii) a first leg extending downwardly from said first end and a second leg extending downwardly from said second end, each said leg having a lower end; and
   iii) a pair of feet, each said foot being connected to a respective one of said first and second legs at said lower end thereof;

b) a shaft extending through said aperture and having upper and lower ends;

c) an engagement member connected to said lower end of said shaft and including a plate having an upper face, a lower face, and at least one opening extending therethrough from said lower face to said upper face, said lower face and said at least one opening for receiving an adhesive for securing said plate to the panel in the area of the dent; and d) a knob connected to said shaft proximate said upper end thereof; wherein e) said shaft threadably engages one of said knob and said bridge such that application of a rotational force to said knob acts to draw said engagement member toward said bridge.

2. The dent puller as in claim 1 wherein said legs extend downwardly from the respective ends of said center section at an angle of less than ninety degrees.

3. The dent puller as in claim 2 wherein said angle is approximately forty-five degrees.

4. The dent puller as in claim 1 and further including a resilient pad attached to a lower surface of each of said feet.

5. The dent puller as in claim 1 wherein said feet each extend outwardly from the lower end of the respective leg.

6. The dent puller as in claim 5 wherein said feet are round.

7. The dent puller as in claim 1 and further including a power tool adapter, comprising a socket engageable with said knob and an arbor extending axially outward from said socket.

8. The dent puller as in claim 7 wherein said knob includes a hub having number of lugs extending radially outward therefrom and said socket includes a like number of notches engageable with said lugs.

9. The dent puller as in claim 7 wherein at least a portion of said arbor is hollow to provide clearance for said upper end of said shaft.

10. A dent puller for removing a dent from a panel, comprising:

a) a bridge having:
   i) a center section with opposed ends, said center section having an aperture extending therethrough between said ends;
   ii) a pair of legs, each said leg extending outwardly and downwardly from a respective end of said center section at an angle of approximately forty-five degrees, each said leg having a lower end; and
   iii) a pair of feet, each said foot being connected to the lower end of a respective one of said legs;

b) a shaft extending through said aperture and having upper and lower ends;

c) an engagement member connected to said lower end of said shaft and including a plate having a lower face for receiving an adhesive for securing said plate to the panel in the area of the dent; and d) a knob connected to said shaft proximate said upper end thereof; wherein e) said shaft threadably engages one of said knob and said bridge such that application of a rotational force to said knob acts to draw said engagement member toward said bridge.

11. The dent puller as in claim 10 wherein each said foot extend substantially outward from the lower end of the respective leg.

12. The dent puller as in claim 10 wherein each said foot includes a lower surface and a resilient pad secured to said lower surface.

13. The dent puller as in claim 10 wherein said plate includes at least one opening extending therethrough from said lower face thereof to an upper face.

14. The dent puller as in claim 10 and further including a power tool adapter, comprising a socket engageable with said knob and an arbor extending axially outward from said socket.

15. The dent puller as in claim 14 wherein said knob includes a hub having a number of lugs extending radially outward therefrom and said socket includes a like number of notches engageable with said lugs.

16. The dent puller as in claim 10 wherein at least a portion of said arbor is hollow to provide clearance for said upper end of said shaft.

17. In a dent puller of the type having a bridge with an aperture extending therethrough, a shaft having upper and lower ends and extending through the aperture, an engagement member connected to the lower end of the shaft and adapted to be adhered to an automotive body panel, and a knob connected to the shaft and operable to draw the engagement member toward the bridge, an improved engagement member comprising a plate with an upper face, a lower face, and at least one opening extending through said plate from said lower face to said upper face.

18. In a dent puller of the type having a bridge with an aperture extending therethrough, a shaft having upper and lower ends and extending through the aperture, an engagement member connected to the lower end of the shaft and adapted to be adhered to an automotive body panel, and a knob connected to the shaft and operable to draw the engagement member toward the bridge, a tool adapter comprising a socket engageable with said knob and an arbor extending axially outward from said socket.

19. The power tool adapter as in claim 18 wherein said socket includes a number of radial slots sized and spaced to be engageable with a like number lugs formed on said knob and extending radially outward therefrom.

20. The power tool adapter as in claim 18 wherein at least a portion of said arbor is hollow to provide clearance for said upper end of said shaft.

21. In a dent puller of the type having a bridge with an aperture extending therethrough, a shaft having upper and lower ends and extending through the aperture, an engagement member connected to the lower end of the shaft and adapted to be adhered to an automotive body panel, and a knob connected to the shaft and operable to draw the engagement member toward the bridge, the knob having a hub with a number of lugs extending radially outward therefrom, a tool adapter comprising a socket having a like number of notches engageable with said lugs and an arbor extending axially outward from said socket.

22. The power tool adapter as in claim 21 wherein at least a portion of said arbor is hollow to provide clearance for said upper end of said shaft.

* * * * *